US007413320B2

(12) United States Patent
Shapiro

(10) Patent No.: US 7,413,320 B2
(45) Date of Patent: Aug. 19, 2008

(54) ILLUMINATING ERASER

(75) Inventor: David V. Shapiro, Chicago, IL (US)

(73) Assignee: It's Academic, Inc., Northbrook, IL (US)

( * ) Notice: Subject to any disclaimer, the term of this patent is extended or adjusted under 35 U.S.C. 154(b) by 139 days.

(21) Appl. No.: 11/588,126

(22) Filed: Oct. 26, 2006

(65) Prior Publication Data

US 2008/0101057 A1 May 1, 2008

(51) Int. Cl.
*F21V 33/00* (2006.01)
*B43K 29/10* (2006.01)

(52) U.S. Cl. ..... 362/109; 362/118; 15/428; 401/52

(58) Field of Classification Search ..... 362/109, 362/118, 579, 253; 401/52; 15/424, 427, 15/428

See application file for complete search history.

(56) References Cited

U.S. PATENT DOCUMENTS

| | | | | |
|---|---|---|---|---|
| 2,261,320 | A * | 11/1941 | Williams | 362/579 |
| 6,238,057 | B1 * | 5/2001 | Chen | 362/118 |
| 6,830,403 | B2 * | 12/2004 | Tsai | 401/195 |
| 6,955,445 | B2 * | 10/2005 | Omowale | 362/118 |
| 2007/0223214 | A1 * | 9/2007 | Yen | 362/118 |

* cited by examiner

*Primary Examiner*—Stephen F. Husar
*Assistant Examiner*—Peggy A. Neils
(74) *Attorney, Agent, or Firm*—Wood, Phillips, Katz, Clark & Mortimer

(57) ABSTRACT

An illuminating eraser is provided. The eraser includes a body and an insert. The insert is receivable within a hollow portion of the body and includes a power source and a light emitting source. The power source is activated by applying pressure to the insert thereby causing the light emitting device to illuminate.

15 Claims, 2 Drawing Sheets

FIG. 1
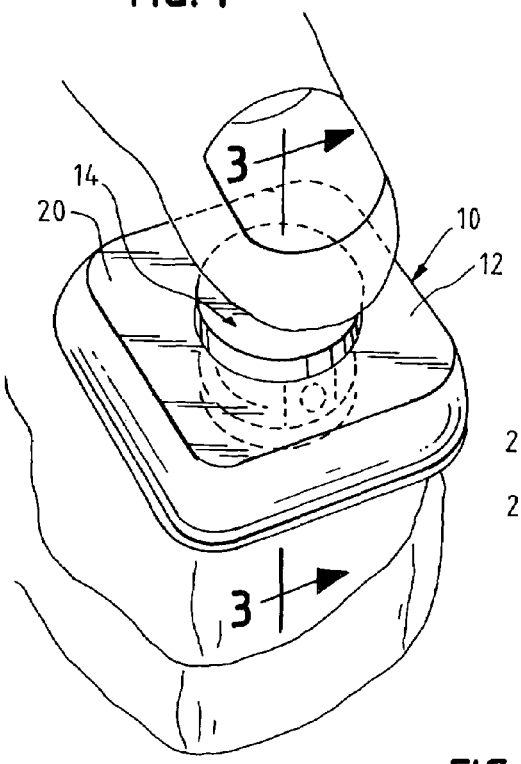
FIG. 2
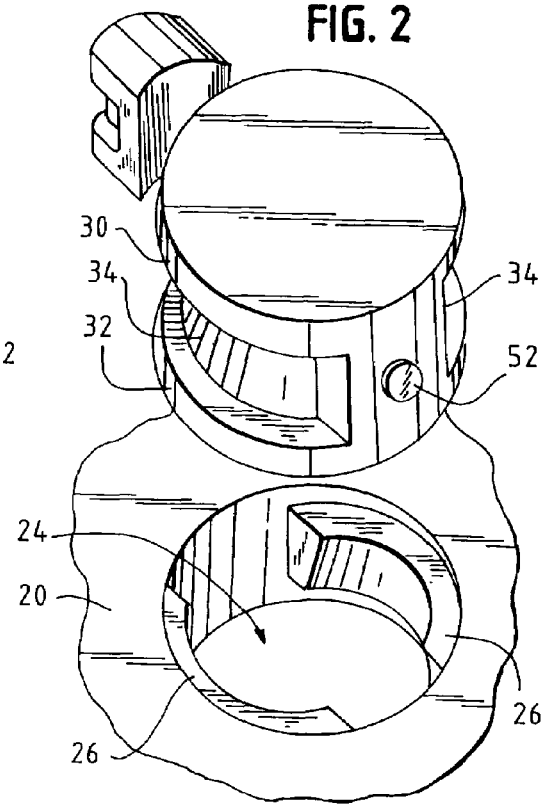
FIG. 3
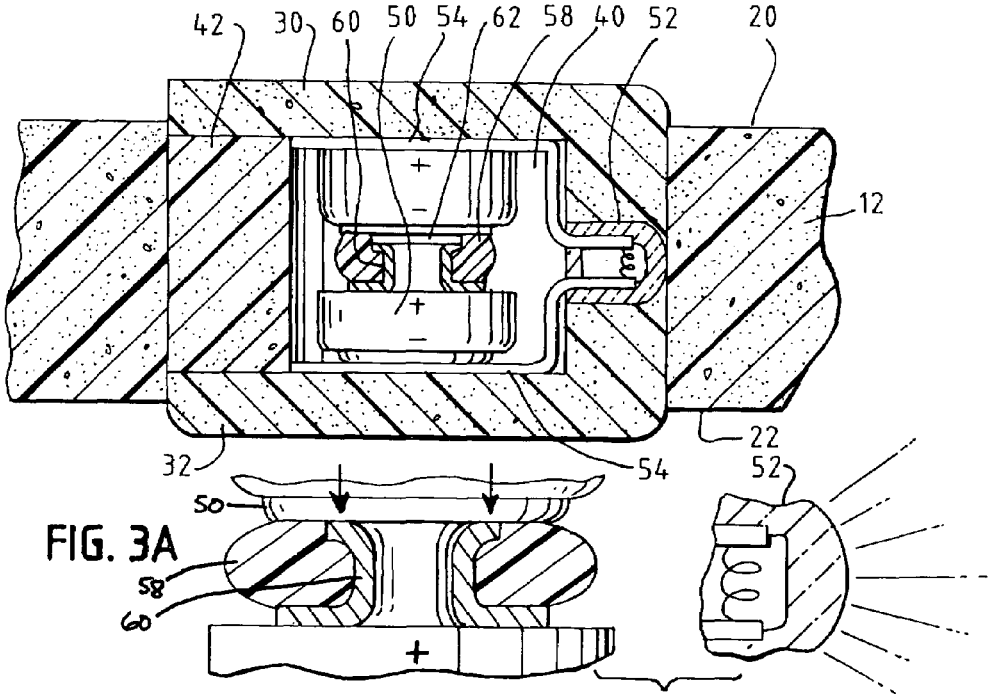
FIG. 3A

ILLUMINATING ERASER

FIELD OF THE INVENTION

This invention relates to erasers, and more particularly to erasers having an insert for illuminating the eraser.

BACKGROUND OF THE INVENTION

Erasers are used by a variety of individuals for erasing marks, such as from pencils or pens, from substrates such as paper. Erasers traditionally have been incorporated onto the marking utensil and were small and could wear out quickly. Therefore, larger separate erasers were manufactured to last longer. Furthermore, children desired shaped erasers that could also be used as toys.

Additionally, these toy-like erasers have included additional features such as cartoon images and other features included thereon. However, additional features, such as lights which illuminate the eraser could also be enjoyed by the user as a toy and also as a functional light.

SUMMARY OF THE INVENTION

In accordance with one feature an illuminating eraser is provided. The eraser includes a body and an insert. The body is constructed from a material suitable for erasing marks from a substrate. The body has an upper surface, a lower surface and a hollow portion located between the upper and lower surfaces. The hollow portion has a first shape and is accessible from at least one of the upper and lower surfaces. The insert has a second shape which is complementary to the first shape of and receivable substantially within the hollow portion through at least one of the upper and lower surfaces. The insert includes a power source located within an interior chamber of the insert and a light emitting device connected to the power source. The power source is activated by applying pressure to the insert thereby causing the light emitting device to illuminate.

In another feature, an illuminating eraser is provided. The eraser includes a body and an insert. The body is constructed from a material suitable for erasing marks from a substrate. The body has an upper surface, a lower surface and a hollow portion located between the upper and lower surfaces. The hollow portion has a first shape including at least two protrusions and is accessible from at least one of the upper and lower surfaces. The insert has a second shape which is complementary to the first shape of and receivable substantially within the hollow portion through at least one of the upper and lower surfaces. The insert includes a power source located within an interior chamber of the insert and a light emitting device connected to the power source. The insert having at least one flange located adjacent at least two protrusions when the insert is located substantially within the hollow portion. The power source is activated by applying pressure to the insert thereby causing the light emitting device to illuminate.

In a further feature, the hollow portion is accessible through both of the upper and lower surfaces.

In another feature, the insert further includes a retaining plug for retaining the power source within the interior chamber of the insert.

According to one feature, the insert is glued in place substantially within the hollow portion.

As one feature, the light emitting device illuminates substantially all of the body.

In accordance with one feature, the power source includes at least one battery located within the interior chamber such that when the insert is squeezed, the battery contacts an electrical contact thereby completing an electrical circuit and illuminating the light emitting device.

In accordance with one feature, the power source includes two batteries located within the interior chamber adjacent one another and having an insulated electrical contact separating the batteries such that when the insert is squeezed, the insulation on the insulated electrical contact is displaced thereby permitting the batteries to make electrical contact and illuminating the light emitting device.

As a further feature, the insert further includes two flanges each located adjacent the at least two protrusions when the insert is located substantially within the hollow portion.

Other objects, features, and advantages of the invention will become apparent from a review of the entire specification, including the appended claims and drawings.

BRIEF DESCRIPTION OF THE DRAWINGS

FIG. 1 is a perspective view of one embodiment of an illuminating eraser with an insert assembled;

FIG. 2 is an enlarged exploded view of the insert of FIG. 1;

FIG. 3 is a cross-sectional view of the interior of an insert in a relaxed state taken along line 3-3 of FIG. 1;

FIG. 3A is partial view of the electrical contact on the interior of an insert in a compressed state;

DETAILED DESCRIPTION OF THE PREFERRED EMBODIMENTS

Figure 4:
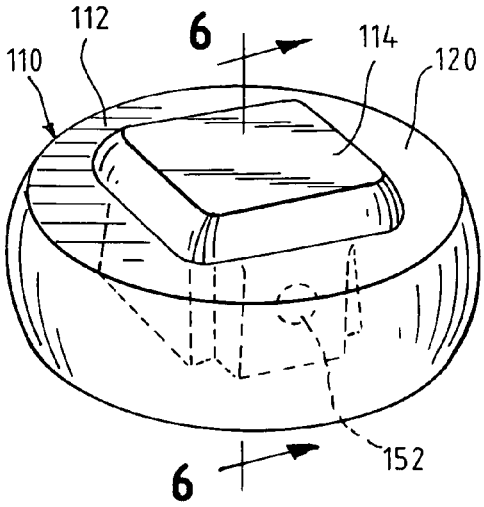
FIG. 4 is a perspective view of another embodiment of an illuminating eraser with an insert assembled.

One embodiment of an illuminating eraser 10 is illustrated between the fingers of a user in FIG. 1. The eraser 10 includes a body 12 and an insert 14. The body 12 is constructed from a material suitable for erasing marks from a substrate. Such suitable materials include polyvinyl chloride (PVC), thermoplastic rubber (TPR), thermoplastic elastomer, combinations thereof and similar materials known to those skilled in the art. In one embodiment, the material(s) chosen may also be translucent or transparent so as to allow light to illuminate the eraser body 12.

The body 12 includes an upper surface 20, a lower surface 22 and a hollow portion 24 located between the upper and lower surfaces 20, 22. The hollow portion 24 has a first shape and is accessible from at least one of the upper and lower surfaces 20, 22. For example, in the embodiment illustrated in FIGS. 2-3, the hollow portion 24 is accessible from both of the upper and lower surfaces 20, 22.

Furthermore, as best seen in FIG. 2, the body 12 also includes protrusions 26. These protrusions extend into the interior of the hollow portion 24 and, in one preferred form, unitary with and made from the same material as the body 12. The protrusions 26 may be used to help define the first shape of the hollow portion 24 and also be used as a "key" to orient the insert 14 during assembly.

The insert 14 has a second shape which is complementary to the first shape of and receivable substantially within the hollow portion 24 through at least one of the upper and lower surfaces 20, 22. As seen in FIG. 2, the insert 14 will be received through the upper surface 20. However, it should be understood that the insert 14, as illustrated in FIG. 2, may also be received through bottom surface 22. In one embodiment, as seen in FIG. 2, the insert also includes an upper flange 30 and a lower flange 32. These flanges 30, 32 may be used to help retain the insert 14 within the hollow body 24.

The shape of the insert 14 is designed to fit within the hollow portion 24. Specifically, once assembled within the hollow portion 24, the insert 14 has a shape which conforms to the outermost shape of the hollow portion 24 and also includes recessed portions 34 which conform to the protrusions 26, if the hollow portion includes protrusions 26. However, it should be understood, if the insert 14 has both upper and lower flanges 30, 32, the one of the flanges 30 or 32 may be required to deform to pass by the protrusions 26 until the insert is fully assembled within the hollow portion 24. The flanges 30, 32 and/or the protrusions may also deform and then deflect back to the respective undeformed shapes. Therefore, the hollow portion 24 and the insert 14 may take any shape desired. For example, the hollow portion 24 and the insert 14 may have a circular, square, rectangular, triangular or other shape as desired. Additionally, the shape of the insert 14 and the hollow portion 24, as well as the protrusions 26 and the recessed portions 34 may key or orient the insert 14 such that it is positioned in a desired fashion within the hollow portion 24.

The insert 14 also includes an interior chamber 40 that may be used to house electrical components for illuminating the eraser 10 (the electrical components will be described in more detail below). Furthermore, the insert 14 includes a retaining plug 42 that may be used to close off the interior chamber 40 and prevent materials, such as dust, dirt, water and the like, from entering the interior chamber and contacting the electrical components. The insert 14, as well as the retaining plug 42 may be made from the same material as the body 12, or may be made from a different material. However, the insert 14 should be made from a flexible material, such as those used for the body 12, so that it may deform during assembly and also be compressed by a user during operation.

As mentioned supra, the electrical components are located within, or substantially within the interior chamber 40. The electrical components include a power source, such as battery 50, and a light emitting source 52. As seen in FIG. 3, the power source actually includes two batteries 50, however, it should be understood that one or more than one battery may be used. The electrical components may include electrical contacts 54 which contact are part of an electrical circuit between the power source and the light emitting source 52.

Furthermore, the electrical components may include an intermediate electrical contact 56, as seen in FIGS. 3-3A. The intermediate electrical contact includes an insulating portion 58 and a conducting portion 60. As seen in FIG. 3, the intermediate electrical contact 56 is in a relaxed state wherein the insulating portion 58 contacts at least one of the batteries 50 and creates a space 62 between the conducting portion 60 and at least one of the batteries. The intermediate electrical contact 56 is shown in FIG. 3A in a compressed state wherein the conducting portion 60 contacts the batteries 50 thereby completing an electrical circuit and illuminating the light emitting source 52. To move from the relaxed state to the compressed state, the insert 14 is compressed by a user, such as between the user's fingers. In one form, the insulating portion 58 is made from the same material as the body 12.

Additionally, in a preferred form, the light emitting source 52 is a light emitting diode (LED). Other forms of light emitting sources 52 may also be used such as light bulbs or other devices known by those skilled in the art. In one form, the light emitting source 52 stays illuminated while the insert 14 is compressed and the electrical components are completing a circuit between the power source and the light emitting source 52. However, in one alternative, the light emitting source flashes while the insert 14 is compressed and the electrical components are completing a circuit between the power source and the light emitting source 52. The light emitting source 52 may be designed to flash in any pattern desired, as understood by those skilled in the art. Additionally, the light emitting source 52 may be colored. For example, the light emitting source 52 may be a blue, red, green, yellow or other colored LED. Similarly, multiple LEDs may be used, in a variety of colors, as a light emitting source 52.

Figure 5:
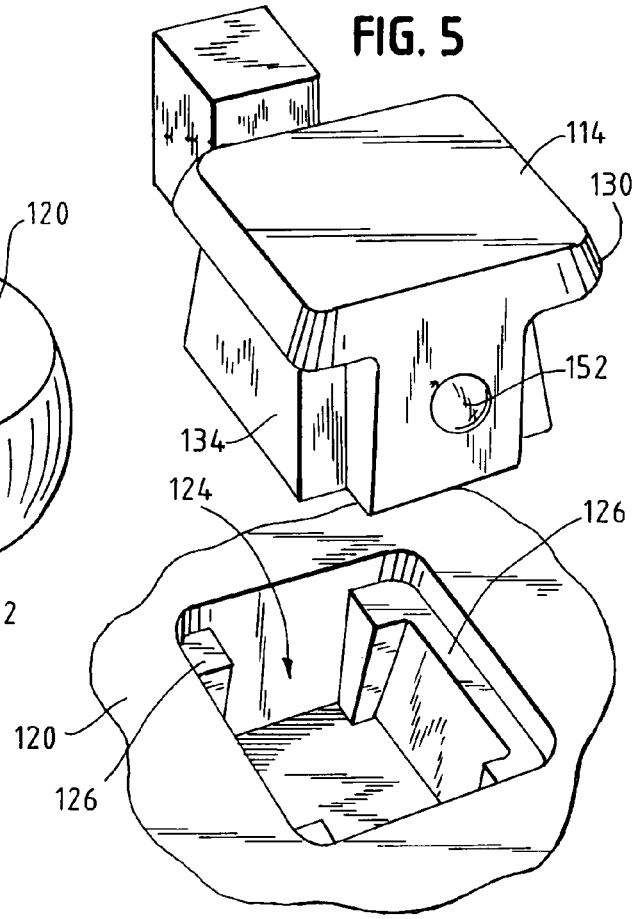
FIG. 5 is an enlarged exploded view of the insert of FIG. 4.

Another embodiment of the eraser 110 is shown in FIGS. 4-5. Similar structure can be found in this embodiment and therefore, will not be discussed for the sake of brevity. However, body 112, as seen in FIG. 5 is only accessible from the top surface 120. Additionally, insert 114, though similar to insert 14 found in FIGS. 1-2, is different in that there is only one flange 130. The shape of insert 114 corresponds to the hollow portion 124 such that the insert 114 is assembled into the hollow portion 124 similarly to the process described supra. Additionally, the protrusions 126 correspond to the recessed portions 134 such that the insert 134 is similarly oriented within the hollow portion 124.

Figure 6:
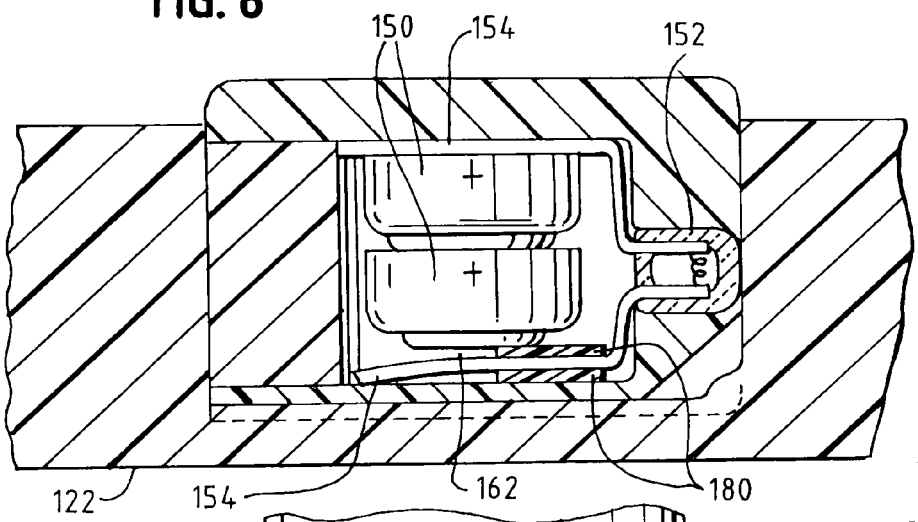
FIG. 6 is a cross-sectional view of the interior of an insert in a relaxed state taken along line 6-6 of FIG. 1.
Figure 6A:
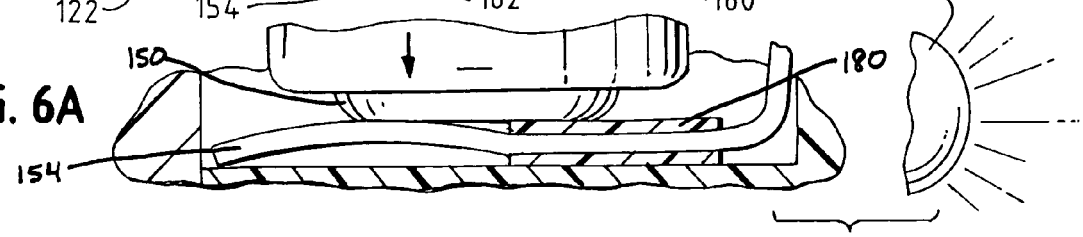
FIG. 6A is a partial view of another embodiment of the electrical contact on the interior of an insert in a compressed state.

Another form of the electrical components are shown in FIGS. 6-6A. In this embodiment, the electrical contacts 154 are slightly different from the electrical contacts 54. Specifically, the electrical contact 154 located near the bottom surface 122 includes additional insulating material 180. This insulating material can be used such that when the insert 114 is in the relaxed state, the insulating material 180 creates a space 162 between the electrical contact 154 and at least one of the batteries 150. The insert 114 is shown in the compressed state in FIG. 6A wherein the insulating material 180 deforms to allow the battery 150 to touch the electrical contact 154 and complete the electrical circuit and illuminate the light emitting source 152. It should be noted that while the insulating material is located only adjacent one battery 150, the insulating material may be placed at either or both of the batteries, or any number of batteries as included in the electrical components. Similarly, it should be noted that this embodiment does not include an intermediate electrical contact. However, the intermediate electrical contact may be included if desired.

It should be understood that the shape of the eraser 10 and 110 may be adjusted and designed as desired. For example, the eraser 10, 110 may take the form of a disc, square, rectangle, tree, heart, star, or any other shape desired. Additionally, the insert 14, 114 may be glued in place to prevent the insert 14, 114 from being easily removed from the body 12, 112. Furthermore, the light emitting source 52, 152 may be oriented within the eraser 10, 110 such that the light is focused towards a desired portion of the eraser shape, such as the top of a tree or a point of a star. Additionally, the light emitting source 52, 152 may illuminated all or substantially all of the body 12, 112.

It will be readily apparent from the foregoing detailed description of the invention and from the illustrations thereof that numerous variations and modifications may be effected without departing from the true spirit and scope of the novel concepts and principles of this invention.

The invention claimed is:

1. An illuminating eraser comprising:

a body constructed from a material suitable for erasing marks from a substrate, the body having an upper surface, a lower surface and a hollow portion located between the upper and lower surfaces, the hollow portion having a first shape and being accessible from at least one of the upper and lower surfaces; and an insert having a second shape which is complementary to the first shape of and receivable substantially within the hollow portion through at least one of the upper and lower surfaces, the insert including a power source located within an interior chamber of the insert and a light emitting device connected to the power source, wherein the power source is activated by applying pressure to the insert thereby causing the light emitting device to illuminate.

2. The illuminating eraser of claim 1 wherein the hollow portion is accessible through both of the upper and lower surfaces.

3. The illuminating eraser of claim 1 wherein the insert further includes a retaining plug for retaining the power source within the interior chamber of the insert.

4. The illuminating eraser of claim 1 wherein the insert is glued in place substantially within the hollow portion.

5. The illuminating eraser of claim 1 wherein the light emitting device illuminates substantially all of the body.

6. The illuminating eraser of claim 1 wherein the power source includes at least one battery located within the interior chamber such that when the insert is squeezed, the battery contacts an electrical contact thereby completing an electrical circuit and illuminating the light emitting device.

7. The illuminating eraser of claim 1 wherein the power source includes two batteries located within the interior chamber adjacent one another and having an insulated electrical contact separating the batteries such that when the insert is squeezed, the insulation on the insulated electrical contact is displaced thereby permitting the batteries to make electrical contact and illuminating the light emitting device.

8. An illuminating eraser comprising:

a body constructed from a material suitable for erasing marks from a substrate, the body having an upper surface, a lower surface and a hollow portion located between the upper and lower surfaces, the hollow portion having a first shape including at least two protrusions and being accessible from at least one of the upper and lower surfaces; and an insert having a second shape which is complementary to the first shape of and receivable substantially within the hollow portion through at least one of the upper and lower surfaces, the insert including a power source located within an interior chamber of the insert and a light emitting device connected to the power source, the insert having at least one flange located adjacent at least two protrusions when the insert is located substantially within the hollow portion wherein the power source is activated by applying pressure to the insert thereby causing the light emitting device to illuminate.

9. The illuminating eraser of claim 8 wherein the hollow portion is accessible through both of the upper and lower surfaces.

10. The illuminating eraser of claim 8 wherein the insert further includes a retaining plug for retaining the power source within the interior chamber of the insert.

11. The illuminating eraser of claim 8 wherein the insert is glued in place substantially within the hollow portion.

12. The illuminating eraser of claim 8 wherein the light emitting device illuminates substantially all of the body.

13. The illuminating eraser of claim 8 wherein the power source includes at least one battery located within the interior chamber such that when the insert is squeezed, the battery contacts an electrical contact thereby completing an electrical circuit and illuminating the light emitting device.

14. The illuminating eraser of claim 8 wherein the power source includes two batteries located within the interior chamber adjacent one another and having an insulated electrical contact separating the batteries such that when the insert is squeezed, the insulation on the insulated electrical contact is displaced thereby permitting the batteries to make electrical contact and illuminating the light emitting device.

15. The illuminating eraser of claim 8 wherein the insert further includes two flanges each located adjacent the at least two protrusions when the insert is located substantially within the hollow portion.

* * * * *